United States Patent [19]

Andersson

[11] Patent Number: 4,539,247

[45] Date of Patent: Sep. 3, 1985

[54] CONSTRUCTIONAL UNIT

[76] Inventor: Hans Andersson, Södra Rundvägen 46, 269 00 Bastad, Sweden

[21] Appl. No.: 566,604

[22] Filed: Dec. 29, 1983

[30] Foreign Application Priority Data

Jan. 11, 1983 [SE] Sweden ..... 8300092

[51] Int. Cl.[3] ..... E04C 2/26; B32B 3/24; B32B 3/30

[52] U.S. Cl. ..... 428/138; 52/454; 52/676; 428/172; 428/192; 428/255; 428/256; 428/285; 428/308.4; 428/920

[58] Field of Search ..... 428/192, 138, 172, 189, 428/256, 308.4, 285, 920, 183, 185; 52/448, 449, 453, 454, 676

[56] References Cited

U.S. PATENT DOCUMENTS 3,154,463 10/1964 Kjell-Berger ..... 428/920
3,357,146 12/1967 Gartrell ..... 52/595

FOREIGN PATENT DOCUMENTS 2842879 4/1980 Fed. Rep. of Germany ..... 52/454

*Primary Examiner*—Paul J. Thibodeau
*Attorney, Agent, or Firm*—Roberts, Spiecens & Cohen

[57] ABSTRACT

A constructional unit applicable to a wall comprising a board including two layers of insulating material joined in face-to-face relation providing an inner and outer surface for the board. The outer surface of the board is provided with V-shaped recesses extending in spaced relation in rows at right angles to one another to intersect and form a waffle pattern with elevated portions of truncated pyramidal shape distributed within the intersecting recesses. A wire net is attached to the outer surface of the board at the elevated portions. Plaster or other mortar is applied to the outer surface of the board to become anchored therewith due to the provision of the elevated portions which oppose movement of the plaster relative to the board to minimize cracking of the plaster after it has hardened in place.

7 Claims, 6 Drawing Figures

CONSTRUCTIONAL UNIT

FIELD OF THE INVENTION

The present invention relates to boards which after placement next to each other, e.g. on a wall, comprise a base surface for joint-free coating with plaster, whereby each board includes one or more layers of insulating material, and a wire net affixed adjacent to one of the surfaces that delimit the insulating material in the board, in addition to which said surface is disposed with elevated portions comprising positioning means for the wire net and with depressions enclosing the elevated portions, by which means the plaster in the depressions forms inter-connected thicker, reinforcing and stabilizing material portions, when the plaster is applied to the board.

PRIOR ART

Plaster often constitutes the external coating of wall surfaces, especially external ones, whereby both mineral-based and plastic plasters are used. Mineral-based plaster is common, despite the fact that it is more sensitive to movement in the base surface than plastic plaster. Such movement always occurs and is caused by such factors as setting of the foundations or changes in the volume of the material in the base surface of the plaster when the temperature or humidiity varies.

The rising price of energy has involved a need for supplementary insulation of outer walls, whereby such insulation is usually undertaken on the outside of the walls. It is thus desirable to preserve the character of the facades of older buildings with plaster exteriors.

The use of wood-wool boards as a base surface for plaster is previously known. These boards are nailed into position in the base surface, after which the plaster is applied to the outside of the boards. Since the wood-wool boards contain a material which expands or shrinks according to the temperature and/or moisture content, this technique produces unsatisfactory results as the plaster cracks after a period of time and the facade must be renovated once again.

SUMMARY OF THE INVENTION

The present invention is directed to a constructional unit in the form of a board adapted for subsequent joint free coating with plaster and so disposed that the aforementioned requirements are met and the aforestated problems eliminated. The board includes one or more layers of insulating material which is delimited by an inner and an outer surface. A wire net is affixed relative to the insulating material adjacent to the outer surface. At least the layer of insulating material that is delimited by the outer surface is characterized by material properties causing the dimensions of the layer to be largely independent of temperature and also independent of ambient humidity. The layer possesses moreover a certain flexibility and elasticity and thereby smoothes out movements of normally occurring magnitudes (e.g. due to settling or temperature fluctuations and/or variations in humidity), for which reason these movements are not transmitted to external layers of plaster. Furthermore, the outer surface is disposed with elevated portions comprising positioning means for the net, in addition to which each elevated portion is surrounded by inter-connected recesses or depressions. When the plaster is applied to the board, continuous thicker material portions of plaster are created in the depressions, in addition to which the wire net is primarily enclosed by the plaster. The wire net thereby comprises a reinforcement of the plaster and forms, together with the thicker material portions, both a reinforcement and an anchoring of the plaster relative to the board.

The elevated portions and depressions form in accordance with the foregoing a lozenge pattern so disposed that thinner material portions in the plaster do not constitute inter-connected material regions which could comprise weakening nicks in the plaster.

In a preferred embodiment, the wire net extends outside the board at least along two adjacent edges of the board. The distance between the outer edge of the wire net and the insulating material is thus so selected that reliable overlapping of the joints between two contiguous boards is achieved. It has been shown that when the said distance amounts to at least double the board thickness, reliable bridging of the joints and a perfect plastered surface are achieved.

In yet another preferred embodiment, the elevated portions and/or depressions are in the form of truncated pyramids.

In one embodiment of the invention, each and every one of the edge surfaces of the boards, i.e. those surfaces which are primarily perpendicular to the said outer surface, is disposed with at least one longitudinal indentation. In the case of boards which are adjacent to window or door openings, for example, the edge regions of the boards are supplemented prior to the application of the plaster by loose net which is attached to the boards by e.g. cramps and bent inwards and attached to each edge surface in order to form reinforcement and for anchoring of the plaster. The indentation or indentations are thereby equivalent to the depressions between the aforementioned elevated portions and during plastering accommodate the plaster material in order to form stabilizing thicker portions of this material in an edge region of the board.

The insulating material in the layer closest to the wire net comprises mineral wool, cellular plastics (e.g. polystyrene) or similar material having properties that cause the layer to retain its dimensions during temperature alterations and in alterations in ambient humidity. It has been shown that e.g. mineral wool with a unit weight of at least 75 kg/m$^3$ satisfies the required standards for compressive strength and existing stresses dependant e.g. on plaster load.

BRIEF DESCRIPTION OF THE DRAWING

The invention is described in further detail in conjunction with a number of figures in the appended drawing, wherein.

DETAILED DESCRIPTION OF A PREFERRED EMBODIMENT

Figure 1:
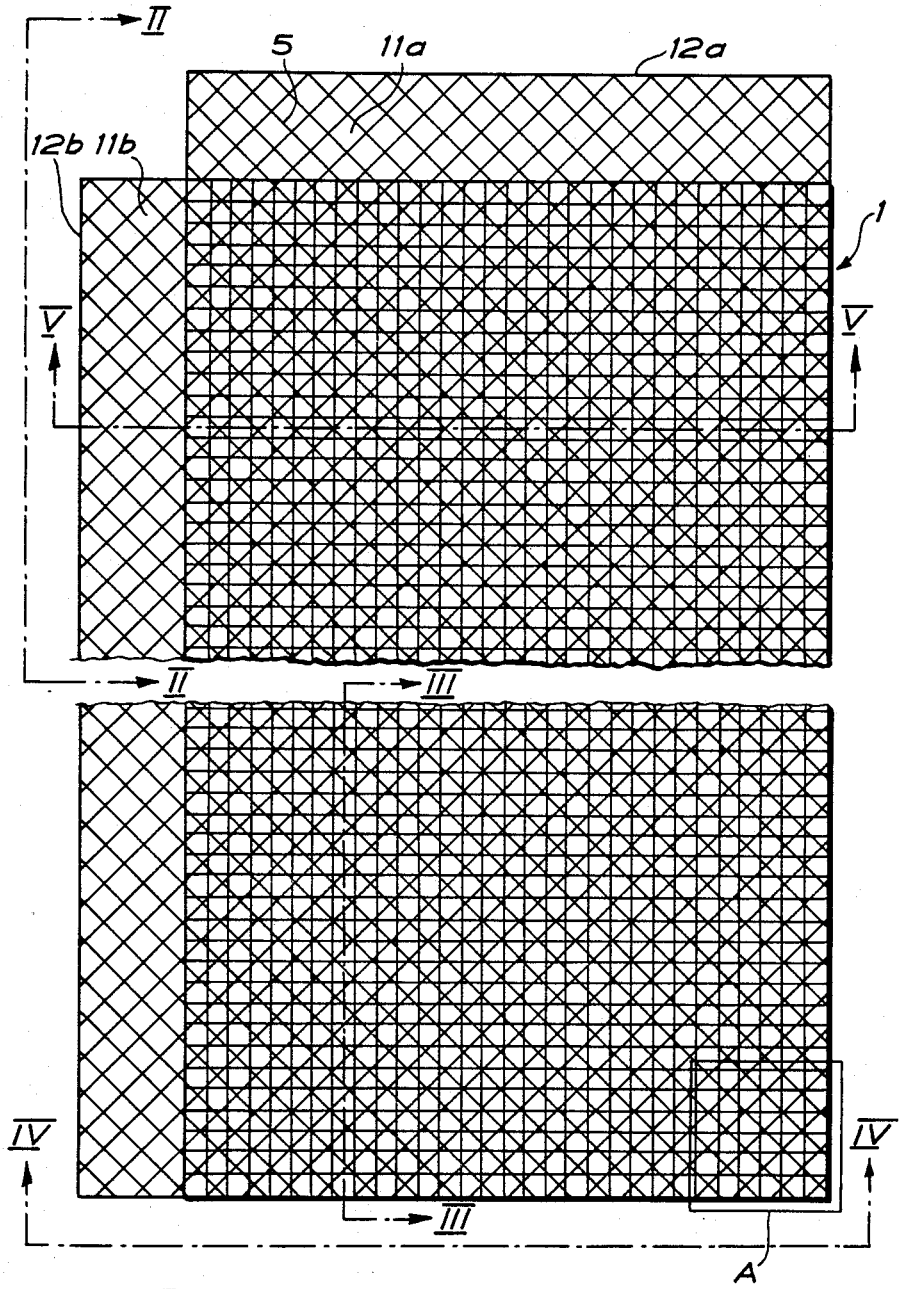
FIG. 1 is a plan view of a board.
Figure 2:
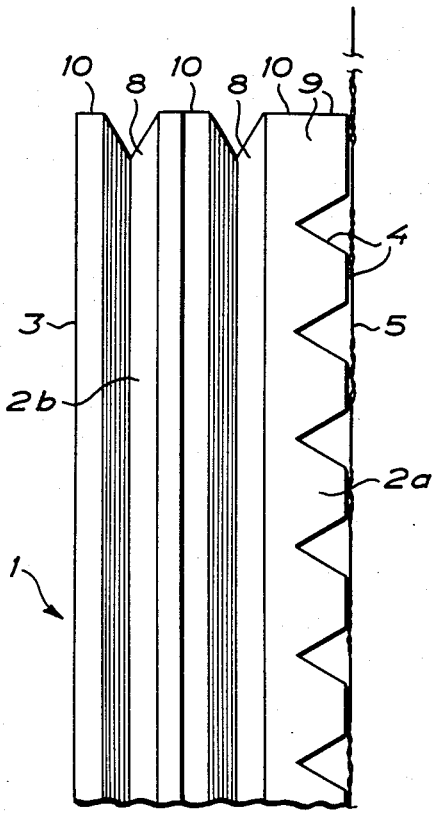
FIG. 2 shows an enlarged side view of the board seen along line II—II in FIG. 1.
Figure 3:
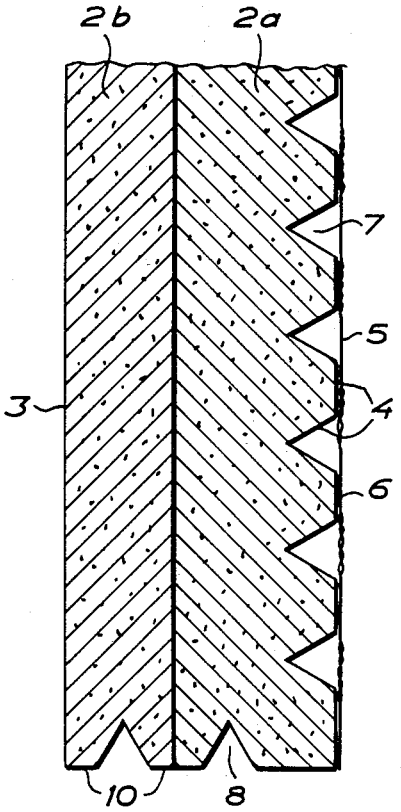
FIG. 3 is an enlarged sectional view taken along line III—III in FIG. 1.
Figure 4:
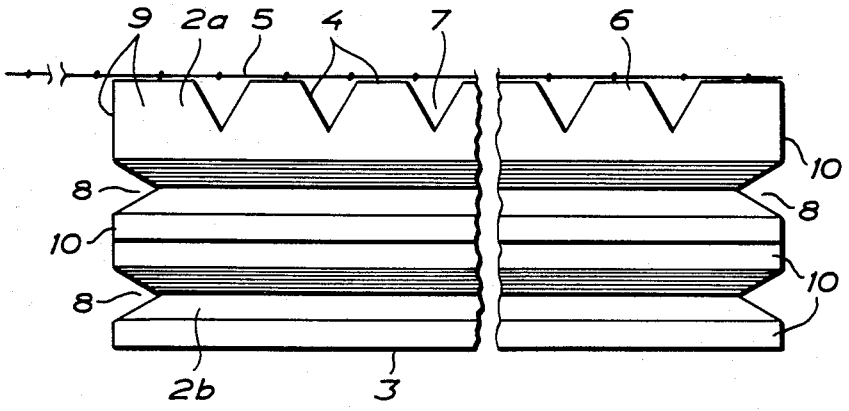
FIG. 4 shows an enlarged side lateral view of the board seen along line IV—IV in FIG. 1.
Figure 5:
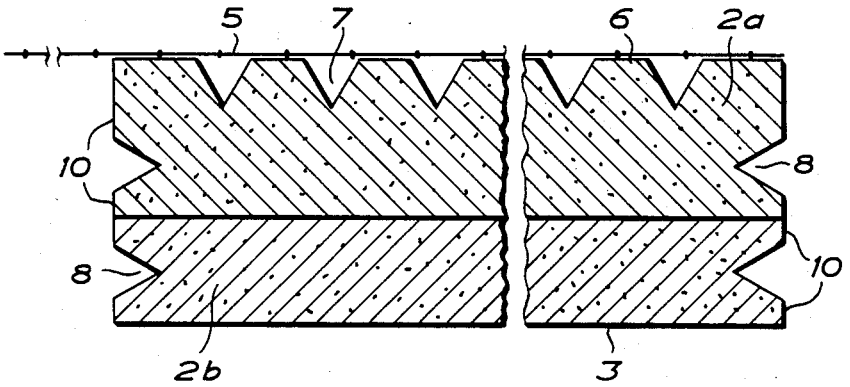
FIG. 5 is an enlarged sectional view taken along line V—V in FIG. 1
Figure 6:
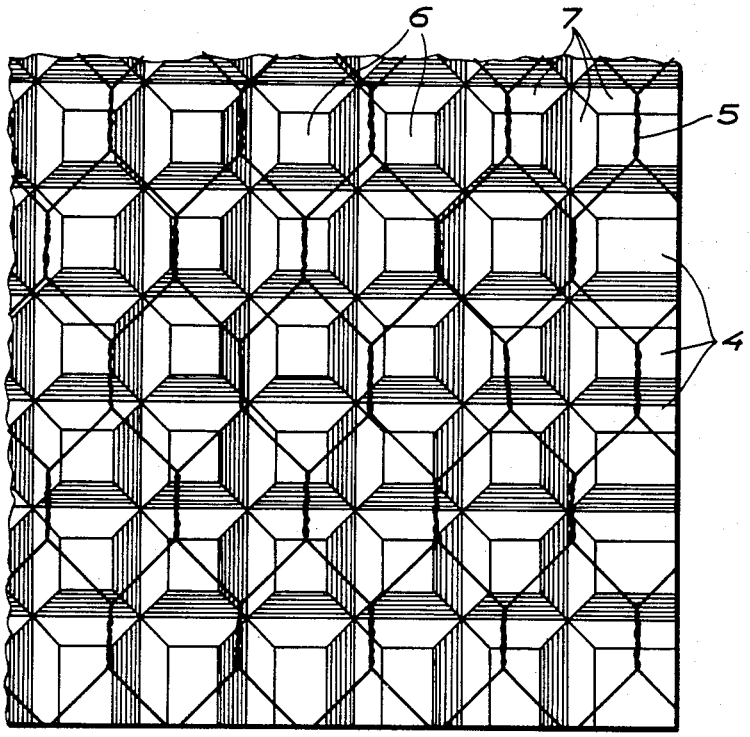
FIG. 6 shows in detail the region A in FIG. 1.

In the embodiment shown in FIGS. 1–6 a board 1 is composed of two layers 2*a*,2*b* of insulating material, in addition to which a wire net 5 is affixed to the upper layer 2*a* of insulating material in the board. The upper surface of the layer 2*a* shown in FIGS. 1 and 6 comprises, when the board is attached to a wall, the outer surface of the layer and is therefore henceforth termed the outer surface 4 of the board and the opposite surface the inner surface 3. The outer surface is composed of elevated portions 6 and recesses or depressions 7 which in the embodiment shown together give the outer surface a waffle pattern. The wire net 5 is sewed in position in the insulating material of the board by means of wire. Both the net and the wire are preferably comprised of galvanized material.

FIG. 1 shows further an embodiment of the invention where the wire net 5 is disposed with portions 11*a*,11*b* which project outwards beyond the insulating material of the board. The distance between the outer edge 12*a*,12*b* of the wire net and the insulating material amounts normally to at least the board thickness and preferably at least twice the board thickness.

FIGS. 2–6 show in detail the design of the edge regions of the board with edge surfaces 9 disposed with longitudinal indentations 8. Depending on the board thickness one or more indentations 8 are separated and enclosed by longitudinal elevated portions 10.

The required necessary dampening of movement in the base surface is achieved when the layer of insulating material has a thickness of approx. 5 cm. That this effect is attained with this thin layer is surprising and facilitates the utilization of thicker boards when improved thermal insulation is required. Such thicker boards can thereby be produced with several layers of insulating material, whereby one or more of the additional layers is produced from insulating material of relatively great rigidity in order to improve the ability of the board to support the plaster load.

In a preferred embodiment, the differences in level between the upper delimiting surfaces of the elevated portions 6 and the delimiting surfaces of the bottom of the depressions 7 are of the order of magnitude of 10 mm, in addition to which the elevated portions are produced as truncated pyramids whose base surface is approx. 4 $cm^2$ and whose top surface is approx. 1 $cm^2$. Moreover, here the wire net is normally formed of galvanized material with a mesh size of around 25 mm. The pattern which the elevated portions and depressions form extends outwards to the edges of the board, whereby there is formed in these edges a saw-toothed delimitation of contiguous elevated portions and depressions, which has a beneficial effect on the adhesion and strength of the plaster in e.g. window and door recesses. The longitudinal indentations 8 are produced in the embodiment shown as V-shaped grooves with a c/c maximum distance of around 20 mm and with a depth of around 10 mm. In the case of boards that lie next to each other the longitudinal elevated portions 10 join together to form closed cavities that ensure good insulation even in the region of the joints between the boards. Practical tests have shown that boards with a size of 600×2000 mm are well suited for use, but the invention is not in any respect restricted to boards of this size.

When a board in accordance with the invention is installed, it is nailed in position by means of e.g. galvanized bell-headed nails against the base surface which may comprise e.g. timber or low-weight concrete. When the supplementary net, which is required in the vicinity of window or door openings, is attached, galvanized cramps with a length of around 30 mm are usually used.

Practical tests have been performed on grouting with masonry cement A (Gullex®) 1:5 and thickness approx. 10 mm and a surface plaster with masonry cement A (Gullex®) 1:7, thickness 10 mm and wood-scraped surface. Extremely good adhesion of the plaster has been found as well as excellent connection and finishing in window and door recesses, reliable affixing of the board to the base surface and absence of tendencies towards cracking or movement in the plaster.

The construction and design of the outer surface with the elevated portions 6 or 10, the depressions 7 and the indentations 8 mean that when the grouting cement is applied, a well-consolidated plaster layer is obtained with good absorbency for the subsequent layer of surface plaster.

The present invention offers a considerable rationalization of the insulation and renovation of e.g. facades. The manual labor at the building site is reduced to a minimum and is performed easily and simply. The possibility of automated and rational production in controlled surroundings in the manufacture of the board, ensures its high quality at the same time as the costs are minimized. It has been shown that compared with previously used technique a halving of the costs of a fully renovated facade is obtained.

What is claimed is:

1. A constructional unit applicable to a wall comprising a board including a layer of insulating material having inner and outer surfaces, a wire net attached to said layer at said outer surface, said layer being provided at said outer surface with V-shaped recesses extending in spaced relation in rows at right angles to one another to intersect and form a waffle pattern with elevated portions of truncated pyramidal shape distributed within the intersecting recesses such that plaster applied to said outer surface of said layer becomes anchored to said layer by said wire net and said elevated portions which oppose movement of the plaster relative to said layer and minimize cracking of the plaster.

2. A constructional unit as claimed in claim 1 wherein said layer of insulating material has a greater flexibility than the hardened plaster.

3. A constructional unit as claimed in claim 1 wherein said layer has edge surfaces in which are provided at least one indentation extending longitudinally of said layer.

4. A constructional unit as claimed in claim 3 wherein said wire net extends beyond said edges.

5. A constructional unit as claimed in claim 4 wherein the extension of the wire net beyond the edges of the layer is by an amount at least equal to the thickness of said board.

6. A constructional unit as claimed in claim 1 wherein said layer of insulating material has a unit weight of at least 75 $Kg/m^3$.

7. A constructional unit as claimed in claim 3 wherein said board includes a second layer of insulating material joined to the first said layer, said second layer having edge surfaces coextensive with the edge surfaces of said first layer and provided with at least one indentation extending longitudinally of said second layer.

* * * * *